US006869519B2

(12) United States Patent
Koyama

(10) Patent No.: US 6,869,519 B2
(45) Date of Patent: Mar. 22, 2005

(54) ELECTROLYTIC PROCESS FOR THE PRODUCTION OF METALLIC COPPER AND APPARATUS THEREFOR

(75) Inventor: Kazuya Koyama, Tsukuba (JP)

(73) Assignee: National Institute of Advanced Industrial Science and Technology (JP)

( * ) Notice: Subject to any disclaimer, the term of this patent is extended or adjusted under 35 U.S.C. 154(b) by 92 days.

(21) Appl. No.: 10/229,161

(22) Filed: Aug. 28, 2002

(65) Prior Publication Data

US 2003/0057104 A1 Mar. 27, 2003

(30) Foreign Application Priority Data

Sep. 27, 2001 (JP) ..... 2001-297744
Feb. 28, 2002 (JP) ..... 2002-052823
Feb. 28, 2002 (JP) ..... 2002-052824

(51) Int. Cl.[7] ..... C25B 15/00; C25C 1/12; C25C 7/00

(52) U.S. Cl. ..... 205/585; 205/770; 205/772; 204/237; 204/252; 204/263

(58) Field of Search ..... 204/252, 237, 204/263; 205/585, 746, 772, 770

(56) References Cited

U.S. PATENT DOCUMENTS 4,280,887 A * 7/1981 Konstantouros ..... 205/745
4,545,877 A * 10/1985 Hillis ..... 216/84
6,294,071 B1 * 9/2001 Miller et al. ..... 205/704

OTHER PUBLICATIONS

Kazuya Koyama, "Leaching of Copper from Waste Printed Wiring Boards", Aug. 31, 2001, 34th Autumn Meeting of the Society of Chemical Engineers, Japan.

* cited by examiner

*Primary Examiner*—Donald R. Valentine
(74) *Attorney, Agent, or Firm*—Lorusso, Loud & Kelly

(57) ABSTRACT

An electrolytic process for the production of metallic copper in an electrolytic cell including anode and cathode chambers separated from each other by a porous member, an anode disposed in the anode chamber, and a cathode disposed in the cathode chamber. The process comprises providing an ammoniacal alkaline electrolyte solution containing diammine cuprous ions in each of the anode and cathode chambers, and applying direct current to the anode and cathode to produce metallic copper on the cathode and to produce tetrammine cupric ions on the anode. An electrolytic cell apparatus including anode and cathode chambers separated from each other by a porous member, an anode disposed in the anode chamber, a cathode disposed in the cathode chamber, and a DC current source connected to the anode and cathode, wherein each of the anode and cathode chambers contains an ammoniacal alkaline electrolyte solution containing diammine cuprous ions.

16 Claims, 3 Drawing Sheets

ELECTROLYTIC PROCESS FOR THE PRODUCTION OF METALLIC COPPER AND APPARATUS THEREFOR

BACKGROUND OF THE INVENTION

1. Field of the Invention

This invention relates generally to a process and an apparatus for producing metallic copper and, more specifically, to an electrolytic process and apparatus for producing metallic copper from a copper-containing waste material which copper may be in the form of a metal or a copper compound.

2. Description of Prior Art

The demand for saving of resources and protection of environment becomes an important, urgent problem. Copper is one of the most important metal and many studies have been made for the recovery of copper from copper-containing waste materials. Conventionally, recovery of copper from copper-containing waste materials has been made in a process of producing copper from copper ores by smelting. It is, however, impossible to increase the amount of the copper-containing waste material to be treated together with the copper ores. Another known method of recovering copper from copper-containing waste materials is a wet process in which the waste materials are treated with acid such as sulfuric acid or hydrochloric acid. With this process, not only copper but also various other metals are bleached in the acid solution so that it is necessary to separate a copper compound from other metal compounds in order to increase the purity of the recovered copper.

An electrolytic winning process is an effective method of recovering high purity copper metal from a copper-containing solution. This process, in which a Cu(II) ion electrolyte solution is energized to form metallic copper on the cathode and oxygen on the anode, consumes much electric energy to perform the electrolysis.

SUMMARY OF THE INVENTION

It is, therefore, an object of the present invention to provide an economical process which can recover metallic copper by electrolysis with a reduced electric energy.

Another object of the present invention is to provide an electrolytic process of the above-mentioned type in which metallic copper can be recovered from a waste material, such as printed wiring boards, containing metallic copper.

It is a further object of the present invention to provide an electrolytic cell apparatus which can efficiently produce metallic copper from a copper-containing solution.

In accomplishing the foregoing object, there is provided in accordance with the present invention an electrolytic process for the production of metallic copper in an electrolytic cell including anode and cathode chambers separated from each other by a porous member, an anode disposed in the anode chamber, and a cathode disposed in the cathode chamber. The process includes providing an ammoniacal alkaline electrolyte solution containing diammine cuprous ions in each of the anode and cathode chambers, and applying direct current to the anode and cathode to produce metallic copper on the cathode and to produce tetrammine cupric ions on the anode, while substantially preventing migration of the tetrammine cupric ions from the anode chamber to the cathode chamber.

In another aspect, the present invention provides an electrolytic cell apparatus comprising anode and cathode chambers separated from each other by a porous member, an anode disposed in the anode chamber, a cathode disposed in the cathode chamber and a DC current source connected to the anode and cathode, wherein each of the anode and cathode chambers contains an ammoniacal alkaline electrolyte solution containing diammine cuprous ions.

BRIEF DESCRIPTION OF THE DRAWINGS

Other objects, features and advantages of the present invention will become apparent from the detailed description of the preferred embodiments of the invention which follows, when considered in the light of the accompanying drawings in which.

DETAILED DESCRIPTION OF THE PREFERRED EMBODIMENTS OF THE INVENTION

Figure 1:
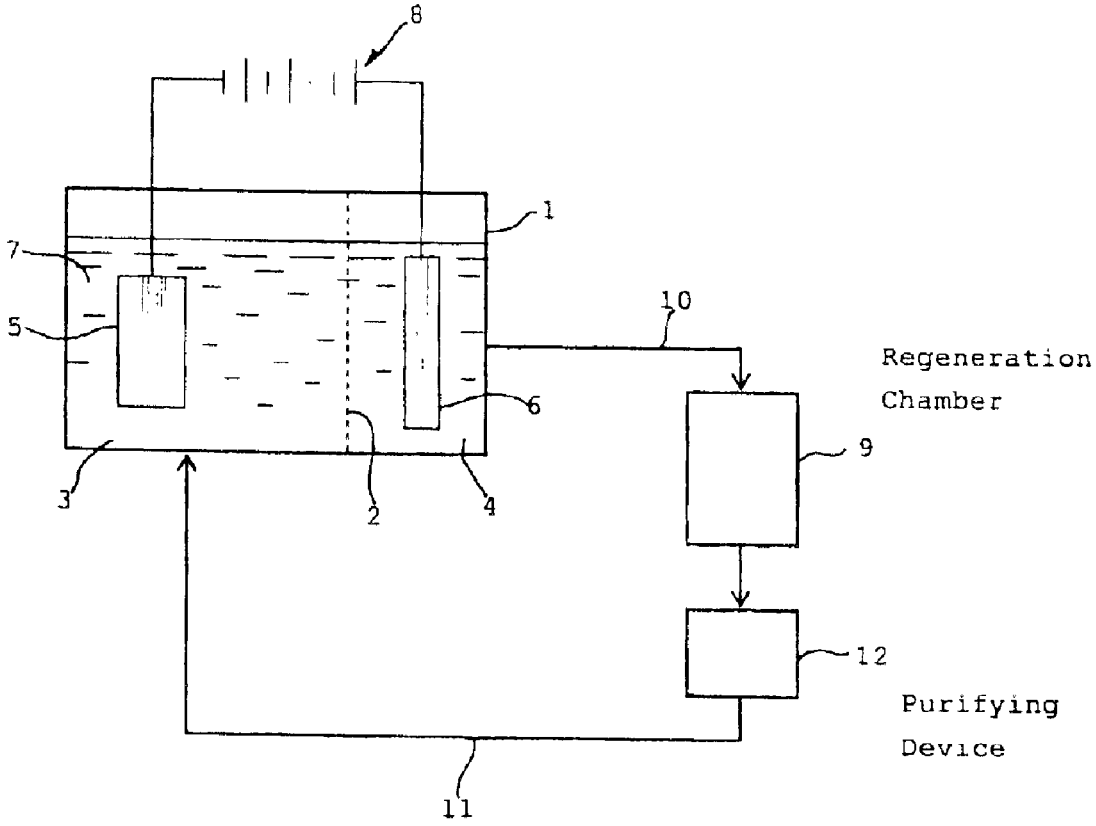
FIG. 1 is a schematic illustration of one embodiment of an electrolytic cell apparatus according to the present invention.

Referring to FIG. 1, the reference numeral 1 denotes an electrolytic cell having a porous member such as a porous diaphragm or membrane 2 which divides the inside space of the housing 1 into a cathode chamber 3 and an anode chamber 4. A cathode 5 and an anode 6 are disposed in the cathode and anode chambers 5 and 6, respectively, and are electrically connected to a DC source 8.

The porous member 2 which should be permeable to the electrolytic solution 7 may be, for example, a cloth or a porous ceramic. A filter cloth for use in filtration processes may be suitably used as the porous member 2. A porous ceramic member may be, for example, a porous sheet having a metal substrate in the form of a net, such as a nickel net, on which sintered nickel carbonyl powder is supported. Such a composite member may be obtained by a roll-pressing nickel carbonyl powder layer together with a metal net to fix the layer on the net, followed by sintering at about 1000° C. under an oxidative atmosphere.

The cathode 5 may be, for example, copper, platinum-plated titanium, stainless steel, titanium, nickel, platinum, alloy 42 (an alloy containing about 42% iron and 58% nickel) or any other metal capable of donating electrons to Cu(I) ions to form electrochemically metallic copper thereon. The anode 6 may be, for example, platinum, nickel, titanium, platinum-plated titanium, iridium oxide, ferrite, stainless steel, graphite, carbon fiber, or a dimension stable anode (DSA). In FIG. 1, pumps, valves and the like devices customarily used in a system including liquid flows are not illustrated.

Contained in each of the cathode and anode chambers 3 and 4 is an ammoniacal alkaline electrolyte solution 7 containing Cu(I) ions including diammine cuprous ions ($[Cu(NH_3)_2]^+$).

When the cathode 5 and the anode 6 are energized by the DC source 8, the following reaction occurs on the cathode 5:

$$[Cu(NH_3)_2]^+ + e = Cu + 2NH_3$$

while the following reaction takes place on the anode 6:

$$[Cu(NH_3)_2]^+ + 2NH_3 = [Cu(NH_3)_4]^{++} + e$$

wherein e represents an electron.

The electrolysis is suitably performed at a temperature of 15–80° C. and at a current density of 200 to 2,000 A/m$^2$.

It is desirable that the electrolytic solution 7 contained in the cathode chamber 3 contains as small an amount of Cu(II) ions as possible for reducing the consumption of electrical energy required for the electrolysis. Thus, it is preferred that the electrolysis be performed while substantially preventing migration of the tetrammine cupric ions from the anode chamber 4 to the cathode chamber 3 by allowing the electrolyte solution 7 to flow from the cathode chamber 3 to the anode chamber 4 through the porous member 2. This can be done by discharging continuously or intermittently a portion of the electrolyte solution 7 from the anode chamber 4 while feeding continuously or intermittently a solution containing Cu(I) ions to the cathode chamber 3.

The ammoniacal alkaline electrolyte solution 7 contains diammine cuprous ions ($[Cu(NH_3)_2]^+$) and, if desired, other Cu(I) complex ions. Examples of Cu(I) complex ions other than diammine cuprous ions include those having, as a ligand, Cl, Br, I, acetonitrile, cyan, phosphine (represented by $PRH_2$, $PR_2H$ or $PR_3$ where R stands for an alkyl group such as methyl, ethyl or propyl or an aryl group such as phenyl, tolyl or naphthyl) or arsine (represented by $AsH_3$, $As_2H_4$, $AsR_3$ or $As_2R_4$ where R stands for an alkyl group such as methyl, ethyl or propyl or an aryl group such as phenyl, tolyl or naphthyl).

The electrolyte solution 7 is preferably produced by reacting a waste material containing metallic copper with an ammoniacal alkaline solution containing a copper(II) ions and a complexing agent. Examples of the complexing agent include ammonium sulfate and ammonium chloride.

In one preferred embodiment, the electrolyte solution 7 may be produced by reacting metallic copper with an ammoniacal alkaline solution containing Cu(II) ions in the presence of a complexing agent such as ammonium sulfate or ammonium chloride. Thus, the electrolyte solution 7 may be preferably produced by discharging the ammoniacal alkaline solution containing tetrammine cupric ions ($[Cu(NH_3)_4]^{++}$) from the anode chamber 4 through a line 10 and introducing the discharged solution into a regeneration chamber 9 containing metallic copper. In the regeneration chamber 9, the metallic copper is oxidized with the tetrammine cupric ions as follows:

$$Cu + [Cu(NH_3)_4]^{++} = 2[Cu(NH_3)_2]^+$$

to form a diammine cuprous ion-containing ammoniacal alkaline solution which is recycled to the cathode chamber 3 through a line 11.

When the metallic copper used in the regeneration chamber 9 is contained in a material in which at least one additional metal element selected from the group consisting of Ni, Co and Zn coexists, the diammine cuprous ion-containing solution from the regeneration chamber 9 may additionally contain ions of the additional metal element. In such a case, the diammine cuprous ion-containing solution discharged from the regeneration chamber 9 is preferably treated, prior to the introduction into the cathode chamber 3, in a purifying device 12, such as an anion exchange resin-packed ion exchanger column, a packed tower containing an ion chelating agent or a solvent extraction tower, to remove the additional metal element therefrom.

It is preferred that the ammoniacal alkaline electrolyte solution 7 have a pH of 8 to 12 for reasons of prevention of formation of precipitates. It is also preferred that the concentration of Cu(I) ions in the ammoniacal alkaline electrolyte solution 7 be at least 5 times as great as the concentration of $NH_3$ contained in the ammoniacal alkaline electrolyte solution 7 for reasons of prevention of formation of precipitates. It is further preferred that the concentration of Cu(I) ions in the ammoniacal alkaline electrolyte solution 7 be at least 6.3 g/L for reasons of prevention of formation of hydrogen on the cathode 5.

As appreciated from the reactions occurring on the cathode 5 and anode 6, the concentration of proton ions or hydroxy ions does not change throughout the electrolysis. Namely, the process according to the present invention does not need any pH control of the electrolyte solution throughout the hydrolysis. However, when oxygen is present and is contacted with the electrolyte solution, the following reaction occurs:

$$2[Cu(NH_3)_2]^+ 4NH_3 + 0.5O_2 + 2H^+ = 2[Cu(NH_3)_4]^{++} + H_2O$$

so that the pH of the electrolyte solution will be changed. This follows that an addition of a pH controlling agent is required in order to smoothly perform the electrolysis. It is therefore preferred that the electrolyte solution is substantially prevented from being contacted with oxygen. This can be achieved by, for example, using an air-tight electrolytic cell and/or an inert gas atomosphere such as nitrogen atmosphere.

The following examples will further illustrate the present invention.

EXAMPLE 1

An ammoniacal alkaline electrolyte solution containing 31.8 g/L of Cu(I) ions (diammine cuprous ions), 5.0 mol/L of $NH_3$ and 1 mol/L of ammonium sulfate was charged in an airtight electrolytic cell whose inside was separated by a filter cloth into a cathode chamber in which a copper cathode was disposed and an anode chamber in which a platinum anode was disposed. The inside space of the electrolytic cell had been deaerated and maintained in a nitrogen atmosphere. Electrolysis was performed at 25° C. by applying a direct current (current density: 500 A/m$^2$) to the cathode and anode. Metallic copper was found to be formed on the cathode with current efficiency of 98% based on the theoretical yield, while copper(II) ions (tetrammine cupric ions) were formed on the anode with current efficiency of 99% based on the theoretical yield. The electrolyte in the cathode chamber was colorless and transparent, while that in the anode chamber turned blue. The consumed electric power was 190 kWh/t which was much smaller than that required for producing metallic copper by an electrolytic winning process using a sulfuric acid electrolyte (2000 to 2500 kWh/t).

EXAMPLE 2

An ammoniacal alkaline electrolyte solution containing 25.2 g/L of Cu(I) ions, 6.3 g/L of Cu(II) ions, 5.0 mol/L of $NH_3$ and 1 mol/L of ammonium sulfate was prepared using 28% aqueous ammonia. The ammoniacal alkaline electrolyte solution was charged in an airtight electrolytic cell whose inside was separated by a filter cloth into a cathode chamber in which a copper cathode was disposed and an anode chamber in which a platinum anode was disposed. The inside space of the electrolytic cell had been deaerated and maintained in a nitrogen atmosphere. Electrolysis was performed at 25° C. by applying a direct current (current density: 500 A/m$^2$) to the cathode and anode. Metallic copper was found to be formed on the cathode with current efficiency of 78% based on the theoretical yield, while copper(II) ions were formed on the anode with current efficiency of 96% based on the theoretical yield. When the above procedure was repeated in the same manner as described except that the electrolysis was carried out at a temperature of 60° C., metallic copper was found to be formed on the cathode with current efficiency of 48% based on the theoretical yield.

EXAMPLE 3

In an aqueous solution containing 5.0 mol/L of $NH_3$, 0.25 mol/L of cupric sulfate and 1 mol/L of ammonium sulfate, a printed wiring board having metallic copper wirings was immersed. The solution was stirred for 8 hours under a nitrogen atmosphere to obtain a substantially colorless solution (ammoniacal alkaline solution containing diammine cuprous ions) which was used as a feedstock.

An airtight electrolytic cell was separated by a permeable filter cloth into a cathode chamber and an anode chamber. A copper plate cathode (4 cm×4 cm) and a platinum plate anode (4 cm×4 cm) were disposed in the cathode chamber and the anode chamber, respectively, with one of the both surfaces of each of the cathode and anode plates being in contact with the inside wall of the cell so that only the other surface of each plate being utilized. The inside space of the electrolytic cell had been deaerated and maintained in a nitrogen atmosphere. An anolite solution (200 ml) which was an aqueous solution containing 5.0 mol/L of $NH_3$, 0.1 mol/L of Cu(I) ions, 0.4 mol/L of Cu(II) ions and 1 mol/L of ammonium sulfate, was charged in the anode chamber, while a catholite solution (200 ml) which was an aqueous solution containing 5.0 mol/L of $NH_3$, 0.5 mol/L of Cu(I) ions and 1 mol/L of ammonium sulfate, was charged in the cathode chamber. The electrolyte in each chamber was stirred with a magnetic stirrer. Electrolysis was performed at 25° C. in the atmosphere of nitrogen for 8 hours by applying a direct current (current density: 500 A/$m^2$) to the cathode and anode while feeding the feedstock to the cathode in an amount of 2 ml per minute with the simultaneous discharge of the same amount of the anolyte from the anode chamber. The average bath voltage was 1.2 V and the current efficiency of 99% based on the theoretical yield. The energy consumption rate was 570 kWh/t.

EXAMPLE 4

A four-layered printed wiring board (10 g) containing 0.95 g of metallic copper was ground into pieces with an average size of about 3.4 mm and placed in a separable flask containing an aqueous ammonia, ammonium sulfate and cupric sulfate to obtain 200 ml of an ammoniacal alkaline solution containing 0.3 kmol/$m^3$ of cupric sulfate, 1.0 kmol/$m^3$ of ammonium sulfate and 5.0 kmol/$m^3$ of ammonia. The mixture in the flask was stirred at a rate of 400 revolutions per minute at a temperature of 25° C. in the atmosphere of nitrogen, while occasionally sampling a portion of the reaction mixture for the quantitative analysis of the concentration of leached copper by ICP emission spectrometer.

Figure 2:
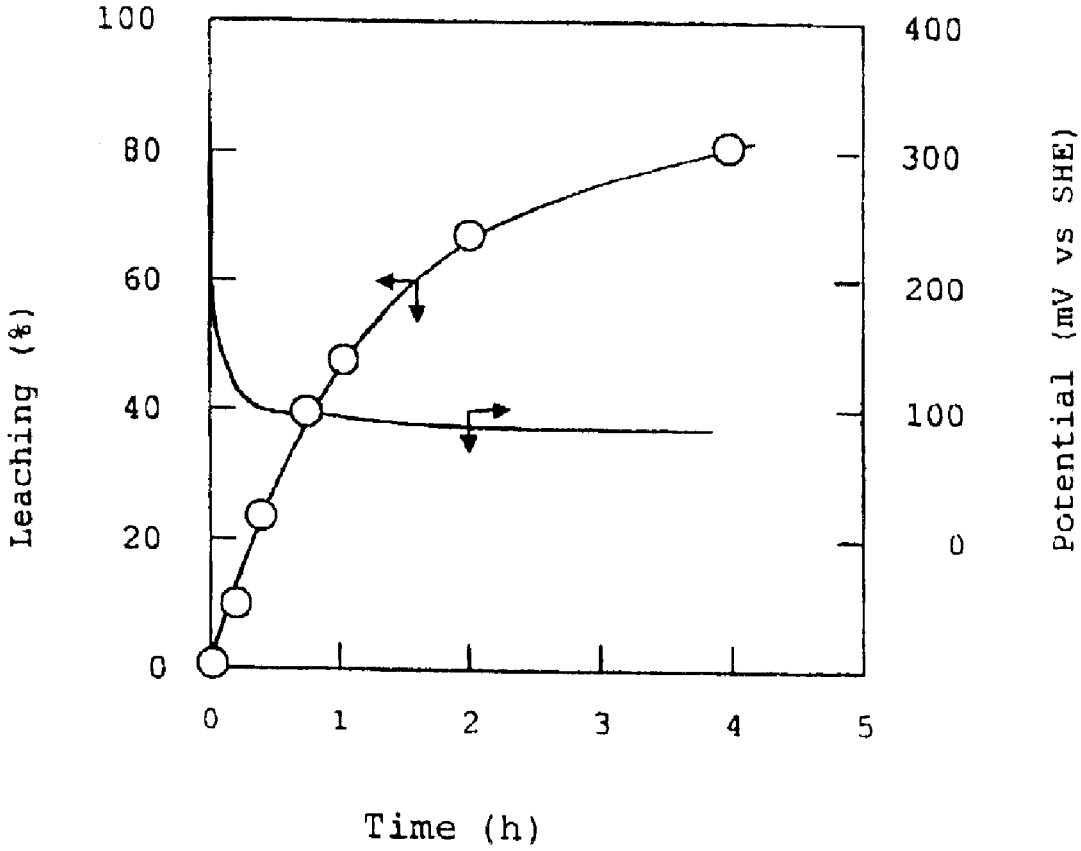
FIG. 2 illustrates graphs showing a change of the rate of leaching with time and showing a change of the oxidation-reduction potential with time.

A relationship between the amount of leached copper and time and a relationship between the oxidation-reduction potential and time are shown in FIG. 2. As will be understood from FIG. 2, leaching proceeds at a constant rate till 1 hour after commencement of the reaction but the reaction rate becomes gradually slow. The amount of the leached copper is about 67% after 2 hour-reaction and is about 82% after 4 hour-reaction. The metallic copper present on a top outer surface and in an area adjacent to the side edges of the printed wiring board was found to be completely leached. However, the metallic copper present inside the board remained unleached. The oxidation-reduction potential initially decreased rapidly but became nearly constant thereafter. The decrease of the oxidation-reduction potential is attributed to the formation of diammine cuprous complex by oxidation of metallic copper with tetrammine cupric complex as follows:

$$Cu+[Cu(NH_3)_4]^{++}=2[Cu(NH_3)_2]^{+}$$

When the above reaction was performed in air, the change of the oxidation-reduction potential was small due to the oxidation of the $[Cu(NH_3)_2]^{+}$ to $[Cu(NH_3)_4]^{++}$ with air.

EXAMPLES 5 AND 6

Figure 3:
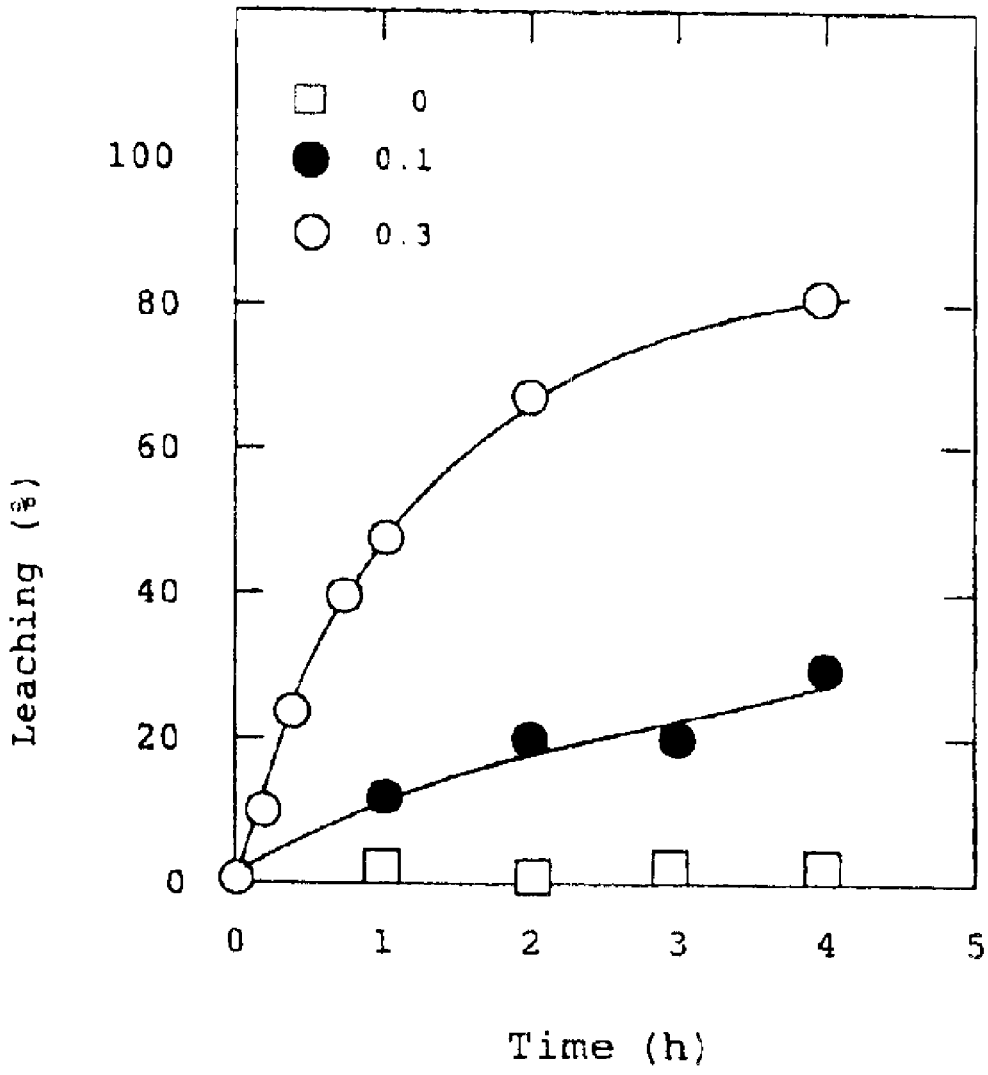
FIG. 3 illustrates graphs showing a change of the rate of leaching with time at different cupric sulfate concentrations.

The above reaction was repeated in the same manner as described except that the amount of cupric sulfate was reduced to 0.1 kmol/$m^3$ (Example 5). Further, similar reaction was performed without using cupric sulfate (Example 6). The results (change of the rate of leaching with time) are shown in FIG. 3 together with the results of Example 5. Almost no copper was leached when no cupric sulfate was contained. The leaching of copper proceeds at a higher rate as the concentration of cupric sulfate increases.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

The teachings of Japanese Patent Applications No. 2001-29774 filed Sep. 27, 2002, No. 2002-52823 filed Feb. 28, 2002 and No. 2002-52824 filed Feb. 28, 2002, inclusive of the specification, claims and drawings, are hereby incorporated by reference herein.

What is claimed is:

1. An electrolytic process for the production of metallic copper in an electrolytic cell including anode and cathode chambers separated from each other by a porous member, an anode disposed in the anode chamber, and a cathode disposed in the cathode chamber, said process comprising:

providing an ammoniacal alkaline electrolyte solution containing diammine cuprous ions in each of the anode and cathode chambers, and applying direct current to the anode and cathode while allowing the electrolyte solution to flow from the cathode chamber to the anode chamber through the porous member to produce metallic copper on the cathode and to produce tetrammine cupric ions on the anode.

2. A process as claimed in claim 1, wherein the electrolyte solution additionally contains copper(I) ions other than diammine cuprous ions so that copper(II) ions other than tetrammine cupric ions are additionally formed on the anode.

3. A process as claimed in claim 1, wherein the electrolyte solution is produced by reacting a waste material containing metallic copper with an ammoniacal alkaline solution containing copper(II) ions and a complexing agent.

4. A process as claimed in claim 1, wherein the electrolyte solution has a pH of 8 to 12.

5. An electrolytic process for the production of metallic copper in an electrolytic cell including anode and cathode chambers separated from each other by a porous member, an anode disposed in the anode chamber, and a cathode disposed in the cathode chamber, said process comprising:

providing an ammoniacal alkaline electrolyte solution containing diammine cuprous ions in each of the anode and cathode chambers, and applying direct current to the anode and cathode to produce metallic copper on the cathode and to produce tetrammine cupric ions on the anode, wherein the electrolyte solution is substantially prevented from being contacted with oxygen.

6. A process as claimed in claim 5, wherein the electrolyte solution additionally contains copper(I) ions other than diammine cuprous ions so that copper(II) ions other than tetrammine cupric ions are additionally formed on the anode.

7. A process as claimed in claim 5, wherein the electrolyte solution is produced by reacting a waste material containing metallic copper with an ammoniacal alkaline solution containing copper(II) ions and a complexing agent.

8. A process as claimed in claim 5, wherein the electrolyte solution has a pH of 8 to 12.

9. An electrolytic process for the production of metallic copper in an electrolytic cell including anode and cathode chambers separated from each other by a porous member, an anode disposed in the anode chamber, and a cathode disposed in the cathode chamber, said process comprising:

providing an ammoniacal alkaline electrolyte solution containing diammine cuprous ions in each of the anode and cathode chambers, and applying direct current to the anode and cathode to produce metallic copper on the cathode and to produce tetrammine cupric ions on the anode, discharging the electrolyte solution from the anode chamber, reacting the discharged electrolyte solution with the metallic copper in the presence of a complexing agent to obtain a diammine cuprous ion-containing solution, and recycling at least a part of the diammine cuprous ion-containing solution to the cathode chamber.

10. A process as claimed in claim 9, wherein the metallic copper is contained in a material in which at least one additional metal element selected from the group consisting of Ni, Co and Zn coexists, so that the diammine cuprous ion-containing solution additionally contains ions of said additional metal element, said process further comprising, before said recycling, treating the diammine cuprous ion-containing solution to remove said additional metal element therefrom.

11. A process as claimed in claim 9, wherein the electrolyte solution additionally contains copper(I) ions other than diammine cuprous ions so that copper(II) ions other than tetrammine cupric ions are additionally formed on the anode.

12. A process as claimed in claim 9, wherein the electrolyte solution is produced by reacting a waste material containing metallic copper with an ammoniacal alkaline solution containing copper(II) ions and a complexing agent.

13. A process as claimed in claim 9, wherein the electrolyte solution has a pH of 8 to 12.

14. An electrolytic cell apparatus comprising:

anode and cathode chambers separated from each other by a porous member, an anode disposed in said anode chamber, a cathode disposed in said cathode chamber, and a DC current source connected to said anode and cathode, wherein each of said anode and cathode chambers contains an ammoniacal alkaline electrolyte solution containing diammine cuprous ions; and a regeneration chamber containing a metallic copper containing material and a complexing agent, a feed passage connecting said anode chamber and said regeneration chamber for feeding the electrolyte solution from said anode chamber to said regeneration chamber, so that the electrolyte solution fed to the regeneration chamber is reacted with the metallic copper in the presence of the completing agent to yield a diammine cuprous ion-containing solution, and a recycling passage connecting said regeneration chamber and said cathode chamber for recycling at least a part of the diammine cuprous ion-containing solution to said cathode chamber.

15. An electrolytic cell apparatus as claimed in claim 14, wherein each of said cathode chamber, anode chamber, regeneration chamber, feed passage and recycling passage is sealed to prevent air from contacting with the electrolyte solution passing therethrough.

16. An electrolytic cell apparatus as claimed in claim 14, further comprising a purifying device provided in said recycling passage for removing a metal ion contaminant selected from Ni, Co and Zn ions from the diammine cuprous ion-containing solution.

* * * * *

UNITED STATES PATENT AND TRADEMARK OFFICE

CERTIFICATE OF CORRECTION

PATENT NO. : 6,869,519 B2
DATED : March 22, 2005
INVENTOR(S) : Kazuya Koyama

It is certified that error appears in the above-identified patent and that said Letters Patent is hereby corrected as shown below:

Column 8,
Line 31, change “completing” to -- complexing --.

Signed and Sealed this

Twenty-first Day of March, 2006

JON W. DUDAS
*Director of the United States Patent and Trademark Office*